US007538499B2

(12) United States Patent
Ashdown

(10) Patent No.: US 7,538,499 B2
(45) Date of Patent: May 26, 2009

(54) METHOD AND APPARATUS FOR CONTROLLING THERMAL STRESS IN LIGHTING DEVICES

(75) Inventor: Ian Ashdown, West Vancouver (CA)

(73) Assignee: TIR Technology LP, Burnaby, BC (CA)

( * ) Notice: Subject to any disclaimer, the term of this patent is extended or adjusted under 35 U.S.C. 154(b) by 355 days.

(21) Appl. No.: 11/366,364

(22) Filed: Mar. 2, 2006

(65) Prior Publication Data

US 2006/0202914 A1 Sep. 14, 2006

Related U.S. Application Data

(60) Provisional application No. 60/658,857, filed on Mar. 3, 2005.

(51) Int. Cl.
*H05B 37/02* (2006.01)

(52) U.S. Cl. ..... 315/309; 315/118; 315/307

(58) Field of Classification Search ..... 315/291, 315/307, 308, 309, 118, 149, 157
See application file for complete search history.

(56) References Cited

U.S. PATENT DOCUMENTS

| | | | | |
|---|---|---|---|---|
| 3,449,629 | A * | 6/1969 | Wigert et al. | 315/151 |
| 4,633,525 | A | 12/1986 | Eumurian | |
| 4,680,536 | A | 7/1987 | Roszel et al. | |
| 4,952,949 | A | 8/1990 | Uebbing | |
| 5,030,844 | A | 7/1991 | Li et al. | |
| 5,262,658 | A | 11/1993 | Jankowski | |
| 5,309,084 | A | 5/1994 | Jiang | |
| 5,825,399 | A | 10/1998 | Orlicki et al. | |
| 6,157,143 | A * | 12/2000 | Bigio et al. | 315/307 |
| 6,313,586 | B1 * | 11/2001 | Yamamoto et al. | 315/224 |
| 6,356,774 | B1 * | 3/2002 | Bernstein et al. | 600/323 |
| 6,424,100 | B1 * | 7/2002 | Kominami et al. | 315/307 |
| 6,570,347 | B2 | 5/2003 | Kastner | |
| 6,573,674 | B1 | 6/2003 | Rivet et al. | |
| 6,753,661 | B2 * | 6/2004 | Muthu et al. | 315/307 |
| 6,888,529 | B2 * | 5/2005 | Bruning et al. | 345/102 |

(Continued)

FOREIGN PATENT DOCUMENTS

| | | |
|---|---|---|
| CA | 2419515 | 8/2003 |

(Continued)

OTHER PUBLICATIONS

Application Brief A04: LED Lamp Thermal Properties (2001) Agilent Technologies Inc., 2 pages.

(Continued)

*Primary Examiner*—David Hung Vu
*Assistant Examiner*—Tung X Le

(57) ABSTRACT

The present invention provides a method and apparatus for controlling the thermal stress in lighting devices, for example light-emitting elements, that are exposed to large thermal gradients typically upon start-up, for example light-emitting elements operating in relatively cold ambient environments. The present invention provides an apparatus that can reduce this thermal stress, wherein the apparatus comprises a temperature determination mechanism for evaluating the temperature of the light-emitting elements prior to activation, and a control system to control the drive current such that it is gradually ramped up to the desired steady state peak current value, wherein the ramping of the drive current is dependent on the evaluated temperature of the light-emitting element.

21 Claims, 5 Drawing Sheets

U.S. PATENT DOCUMENTS

| | | | | |
|---|---|---|---|---|
| 6,980,119 | B2 | 12/2005 | Toulmin et al. | |
| 7,091,874 | B2 | 8/2006 | Smithson | |
| 7,140,752 | B2 * | 11/2006 | Ashdown | 362/276 |
| 7,183,727 | B2 * | 2/2007 | Ferguson et al. | 315/308 |
| 7,205,680 | B2 * | 4/2007 | Takeda et al. | 307/10.8 |
| 7,322,718 | B2 * | 1/2008 | Setomoto et al. | 362/276 |
| 7,391,172 | B2 * | 6/2008 | Ferguson et al. | 315/308 |
| 7,446,489 | B2 * | 11/2008 | Jang | 315/309 |
| 2003/0015973 | A1 * | 1/2003 | Ovens et al. | 315/291 |
| 2005/0040773 | A1 * | 2/2005 | Lebens et al. | 315/291 |
| 2005/0275809 | A1 | 12/2005 | Ikebe et al. | |
| 2006/0245174 | A1 * | 11/2006 | Ashdown et al. | 362/85 |
| 2007/0105212 | A1 * | 5/2007 | Oldham et al. | 435/288.7 |

FOREIGN PATENT DOCUMENTS

| | | |
|---|---|---|
| JP | 2001312249 | 11/2001 |

OTHER PUBLICATIONS

Ashdown, I. "Specifying Solid-State Lighting, Photometry and Colorimetry", TIR Systems Limited, copyright 2003-2005, p. 1-27.

Barton et al. (1998) "Life Tests and Failure Mechanisms of GaN/AlGaN/InGaN Light-Emitting Diodes" SPIE vol. 3279, pp. 17-27.

Malyutenko et al. "Heat Transfer Mapping in 3-5 μm Planar Light-Emitting Structures" Journal of Applied Physics. vol. 93(11), Jun. 1, 2003, p. 9398-9400.

Narendran et al., (2004) "Performance Characteristics of High-power Light-emitting Diodes" Third International Conference on Solid State Lighting, Proceedings of SPIE 5187:267-275.

Siegel, B. (2003) "Measurement of Junction Temperature Confirms Package Thermal Design" Laser Focus World, 3 pages.

International Search Report for International (PCT) Patent Application No. PCT/CA2006/000272, mailed Jul. 6, 2006, 3 pages.

* cited by examiner

METHOD AND APPARATUS FOR CONTROLLING THERMAL STRESS IN LIGHTING DEVICES

The present application claims the benefit of U.S. Provisional Application No. 60/658,857, which was filed on Mar. 3, 2005, and is incorporated by reference herein.

FIELD OF THE INVENTION

The present invention pertains to the field of lighting and in particular to a method and apparatus for controlling thermal stress in lighting devices.

BACKGROUND

Recent advances in the development of solid-state light-emitting devices such as light-emitting diodes (LEDs) including semiconductor LEDs, small molecule organic light-emitting diodes (OLEDs) and polymer light-emitting diodes (PLEDs), have made these devices suitable for use in general illumination applications, including architectural, entertainment, and roadway lighting, for example. As such, LEDs are becoming increasingly competitive with light sources such as incandescent, fluorescent, and high-intensity discharge lamps.

LEDs offer a number of advantages and are generally chosen for their ruggedness, long lifetime, high efficiency, low voltage requirements, and above all the possibility to control the colour and intensity of the emitted light independently. They can provide a significant improvement over delicate gas discharge lamps, incandescent bulbs, and fluorescent lighting systems while being capable of providing lighting impressions similar to these technologies.

When drive current is applied to an LED, Joule heating can result in transient thermal gradients exceeding about 3000° C./cm as shown by Malyutenko et al. in "*Heat Transfer Mapping in* 3-5 *um Planar Light-Emitting Structures," Journal of Applied Physics* 93(11), 2003:9398-9400. In addition, localized peak temperatures as high as about 150° C. can be reached under normal operating conditions as shown by Barton et al. in "*Life Tests and Failure Mechanisms of GaN/AlGaN/InGaN Light-Emitting Diodes," SPIE* Vol. 3279, 1998, pp. 17-27. Heat sinking can be used to reduce the average junction temperature of an LED die however this can typically only be done under steady-state conditions since when the drive current is first applied, the localized peak temperature will likely exceed the steady-state value until the generated heat is dissipated through the heat sink.

The thermal stresses due to rapidly heating and cooling of components within lighting systems can lead to a number of failures such as the fracture of wire bonds and lift off of a LED die from the package. As reported in the publication, "*Application Brief A*04: *LED Lamp Thermal Properties," Agilent Technologies* 2001, undue thermal stresses beyond the recommended operational limits can greatly reduce the mean-time-between-failure (MTBF) for LED wire bonds. Also reported in this document is the fact that for temperatures over the range of about 100° C. to 115° C., each increase in maximum storage temperature excursion by about 5° C. lowers the mean number of temperature cycles to failure by about a factor of five. Thus, an LED lamp will fail with about 100 times fewer temperature cycles over a range of about −40° C. to 115° C. than a range of about −40° C. to 100° C. Agilent and other LED manufacturers state that their LEDs can withstand thousands of temperature cycles over a temperature range of about −55° C. to 100° C., however this ability is typically determined under non-operating, or storage, conditions. Assuming that these thermal cycles occur within an environmental chamber with a cycle time of minutes, the thermal gradients and resultant mechanical stresses on the wire bonds are likely to be small, as the LED package will be able to substantially maintain thermal equilibrium, depending on the thermal constant of the heat sink. A worst-case scenario may therefore occur when a LED is connected through a low thermal resistance link to a heat sink with a large thermal constant, and where full drive current is applied to the LED when it is in thermal equilibrium at a low ambient temperature, for example as in the case for an outdoor luminaire operated in winter conditions. For example, if a luminaire is cycled through a sequence that is about ten minutes in length, it is conceivable that this potential worst-case scenario can occur dozens of times in one night.

Thermal stress in lighting systems due to excessive rapid heating and cooling can be managed by controlling the device temperature and the device temperature gradients during operation. For example, U.S. Pat. No. 4,680,536 discloses a dimmer circuit with an input voltage compensated soft start circuit for an incandescent lamp. The dimmer employs a feed-forward phase control mechanism that controls power provided to a load during transient ON/OFF cycles. The invention however, only works with alternating currents which are not suitable for LEDs since they are typically operated with direct currents. U.S. Pat. No. 6,573,674 also discloses a circuit for controlling a load supplied with an alternating current and is similarly unsuitable for LEDs.

In addition, U.S. Pat. No. 4,952,949 describes a form of temperature compensation for an LED print head. The forward voltage of a dummy LED is cyclically measured in order to derive the junction temperatures of an array of LEDs, and subsequently the respective device currents that are necessary to achieve a desired light output are determined. The invention however, does not protect the LEDs from thermal stress resulting from storage at low ambient temperatures for example.

U.S. Pat. No. 5,825,399 also describes thermal compensation for an LED print head for maintaining proper printer calibration as the LED warms up due to thermal energy generation from the drive current. However, thermal stress during the ON/OFF transient periods is not considered.

U.S. Pat. No. 4,633,525 describes a method of thermal stabilization wherein the LED is reverse-biased with a voltage sufficient to induce a current flow equal to the forward-biased current flow, thereby maintaining a constant junction temperature. This method of maintaining the junction temperature of an LED can be inappropriate for some LEDs as the reverse breakdown voltage of the LED may need to be exceeded in order to achieve the desired result.

U.S. Pat. No. 5,262,658 discloses an LED die wherein heater elements are positioned along the sides of the LED. This method of suppressing thermal effects however, results in additional power consumption in order to maintain the temperature of the LEDs at a desired level, which may be relatively large when LEDs are being used in an outdoor environment, for example.

Furthermore, U.S. Pat. No. 5,030,844 discloses a DC power switch for inrush prevention and U.S. Pat. No. 5,309,084 discloses an electronic switch suitable for fading ON/OFF control of electrical equipment like lamps and motors. In both of these disclosures however, the rate at which a signal is provided to a load is predetermined and may not sufficiently reduce thermal stresses in cold environments, for example.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

Therefore, there is a need for a new method and apparatus for reducing the thermal stresses in lighting components such as LEDs that can be exposed to relatively large thermal gradients, for example when they are stored in relatively cold ambient conditions prior to operation.

An object of the present invention is to provide a method and apparatus for controlling thermal stress in lighting devices. In accordance with an aspect of the present invention, there is provided an apparatus for controlling a drive signal provided to one or more light-emitting elements, said apparatus comprising: a temperature determination means operatively connected with one or more of the light-emitting elements, the temperature determination means for detecting a first signal representative of an initial device temperature of said one or more light-emitting elements; and a control means operatively coupled to the one or more light-emitting elements and the temperature determination means, the control means for receiving the first signal and configured to determine an initial drive signal based on the first signal, the control means further for ramping the initial drive signal up to a steady state drive signal based on a predetermined criteria; wherein the control means is adapted for connection to a source of power.

In accordance with another aspect of the invention, there is provided a method for controlling a drive signal provided to one or more light-emitting elements, said method comprising; determining an initial device temperature of said one or more light-emitting elements; determining an initial drive signal based on the initial device temperature; providing the initial drive signal to the one or more light-emitting elements; and ramping the drive signal from said initial drive signal to a steady state drive signal based on a predetermined criteria.

DETAILED DESCRIPTION OF THE INVENTION

Definitions

Figure 1:
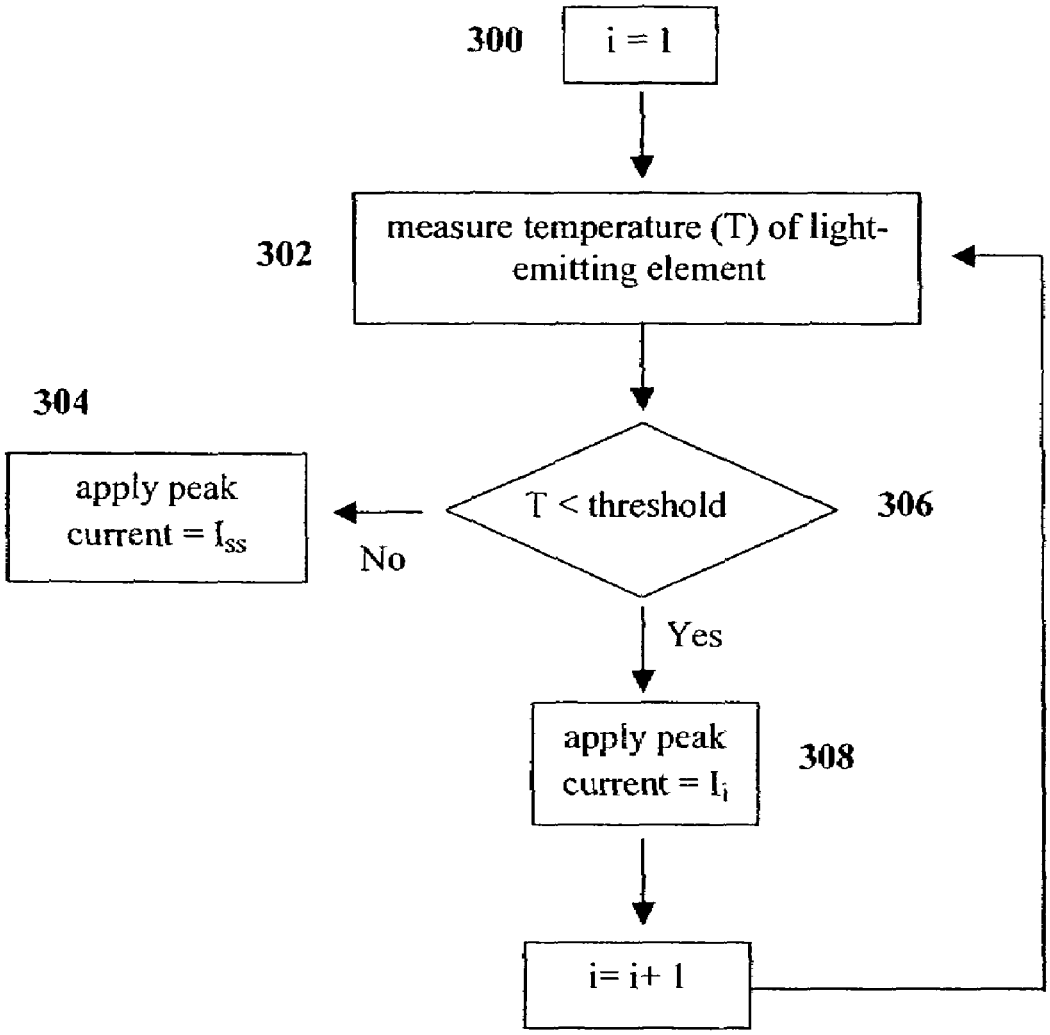
FIG. 1 is a flowchart diagram defining a ramping sequence for the drive current for a light-emitting element, according to one embodiment of the present invention.

The term "light-emitting element" is used to define any device that emits radiation in any region or combination of regions of the electromagnetic spectrum for example, the visible region, infrared and/or ultraviolet region, when activated by applying a potential difference across it or passing a current through it, for example. Therefore a light-emitting element can have monochromatic, quasi-monochromatic, polychromatic or broadband spectral emission characteristics. Examples of light-emitting elements include semiconductor, organic, or polymer/polymeric light-emitting diodes, optically pumped phosphor coated light-emitting diodes, optically pumped nano-crystal light-emitting diodes or any other similar light-emitting devices as would be readily understood by a worker skilled in the art. Furthermore, the term light-emitting element is used to define the specific device that emits the radiation, for example a LED die, and can equally be used to define a combination of the specific device that emits the radiation together with a housing or package within which the specific device or devices are placed.

As used herein, the term "about" refers to a +/−10% variation from the nominal value. It is to be understood that such a variation is always included in any given value provided herein, whether or not it is specifically referred to.

Unless defined otherwise, all technical and scientific terms used herein have the same meaning as commonly understood by one of ordinary skill in the art to which this invention belongs.

The present invention provides a method and apparatus for controlling the thermal stress in lighting devices, for example light-emitting elements, that can be exposed to large thermal gradients typically upon start-up, for example light-emitting elements operating in relatively cold ambient environments. The present invention provides an apparatus that can reduce this thermal stress, wherein the apparatus comprises a temperature determination mechanism for evaluating the temperature of the one or more light-emitting elements prior to activation, and a control system to control the drive current such that it is gradually ramped up to the desired steady-state peak current value, wherein the ramping of the drive current is dependent on the evaluated temperature of the one or more light-emitting elements.

The evaluated temperature can provide a means for the control system to initialize a starting current value, which may be the steady-state peak current value or a fraction thereof. The temperature of the one or more light-emitting elements can be evaluated one or more predetermined times during this current ramping procedure. If the ambient temperature is below a predetermined threshold, the drive current supplied to the one or more light-emitting elements can be gradually ramped up to its desired steady state value. If the ambient temperature is above this threshold the steady state drive signal can be applied to the one or more light-emitting elements. Thus, when the ambient temperature is below a certain threshold value, the ramping of the drive current can allow the temperature of the various components of the one or more light-emitting elements to increase relatively gradually thereby reducing the thermal stress they would otherwise experience.

In one embodiment of the present invention, the thermal stress is controlled in an LED-based lighting system and the drive current and thus the temperature of the LEDs is ramped up over tens of milliseconds.

As would be readily understood, the rate at which the drive current is ramped up, the threshold temperature and the value of the steady state current applied can depend on the particular design and properties of the lighting system as well as desired illumination conditions. For example, the physical design of the light-emitting element which may include the package associated therewith, and heat sink design of the lighting system among other parameters, can aid in the determination of the manner in which the drive current is ramped up.

In one embodiment of the present invention, the initial temperature associated with the light-emitting elements is determined prior to activation, for example when the light-emitting elements are in thermal equilibrium with the ambient surroundings. The appropriate drive current is subsequently applied based on this initial temperature value. A temperature associated with the light-emitting elements is then repeatedly measured until the particular temperature threshold is reached where the desired steady state peak current can be applied with a relatively low amount of thermal stress induced in the light-emitting elements.

In another embodiment of the present invention, the initial temperature of the light-emitting elements is measured prior to activation, for example when the light-emitting elements are in thermal equilibrium with the ambient surroundings and an appropriate drive current is applied. The drive current is then ramped up at a predetermined rate to the desired steady state peak current without repeatedly measuring the temperature associated with the light-emitting elements. As would be readily understood, the temperature may be measured at any desired time during operation of the light-emitting elements.

FIG. 1 illustrates a logic diagram for the operation of one embodiment of the present invention. For example, the sequence is initialized in step 300 where a parameter i is set to a value of 1, and the temperature (T) of the light-emitting element is then measured in step 302. The measured temperature is compared to a predetermined temperature threshold value in step 306 and based on this comparison a predetermined peak current will be applied to the light-emitting element, wherein this peak current is either the steady state peak current ($I_{ss}$) applied in step 304 or a fraction thereof defined by $I_i$ and applied in step 308. If a fraction of the steady state peak current is being applied this current can be applied for a predetermined amount of time and subsequently a re-measurement of the temperature of the light-emitting element is performed. If the threshold temperature value has not been obtained, a larger fraction of the steady state peak current is subsequently applied to the light-emitting element. The increase in the fraction of the steady state peak current being applied can be based on a predetermined incremental formulation, which can be linear or non-linear in nature. Once the threshold temperature value is obtained the steady state peak current can be applied to the one or more light-emitting elements.

Figure 2:
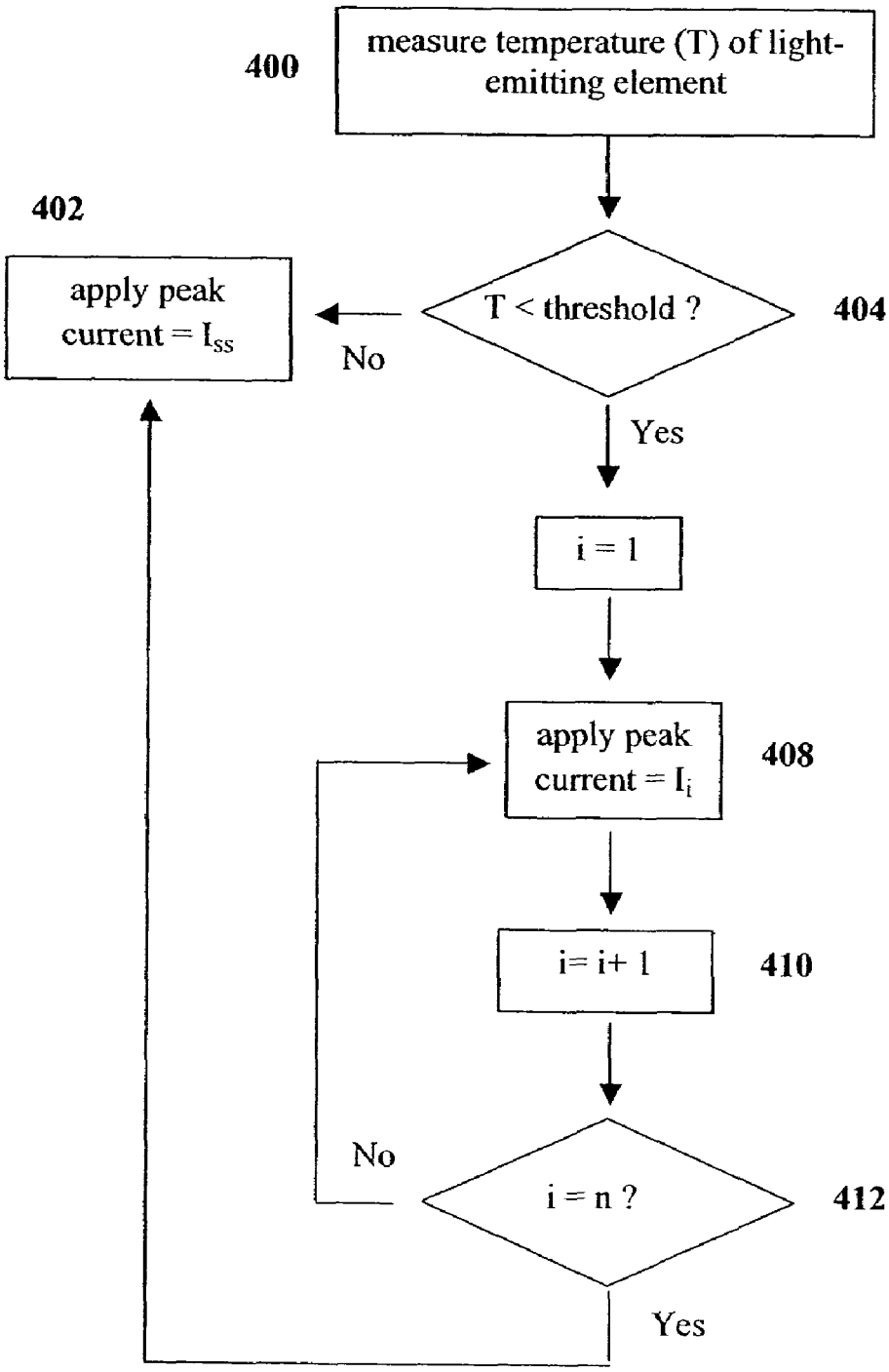
FIG. 2 is a flowchart diagram defining a ramping sequence for the drive current for a light-emitting element, according to another embodiment of the present invention.

FIG. 2 illustrates a logic diagram for the operation of another embodiment of the present invention. This embodiment is similar to FIG. 1, wherein the initial temperature of the light-emitting element is measured in step 400 and subsequently compared to the threshold temperature value in step 404 for subsequent application of either the steady state peak current in step 402 or a fraction thereof in step 408. In this embodiment, the fraction of the steady state peak current is increased sequentially based on a predetermined formulation, which can be linear or non-linear in nature, over a predetermined time period as defined in steps 410, 412, up to the steady state peak current. Therefore subsequent to the initial temperature reading, this embodiment assumes that steady state peak current can be applied after a predetermined ramping period.

Temperature Determination Mechanism

The temperature determination mechanism provides a means for the evaluation of the temperature of the one or more light-emitting elements. This collected information is used by the control system for the generation of appropriate control signals for activation of the one or more light-emitting elements.

In one embodiment of the present invention the temperature determining means is a temperature sensor such as a thermistor, bimetallic thermocouple switch, or any other temperature sensor as would be readily understood. The sensor is placed in close proximity to the light-emitting elements such that a relatively accurate measurement of the temperature is obtained. For example, the temperature sensor may be mounted in close proximity to one or more of the light-emitting elements mounted on a substrate. If for example, the substrate upon which the light-emitting elements are mounted, is highly thermally conductive, the temperature sensor may be positioned at a distance further from the light-emitting elements while providing a sufficiently accurate measurement of the temperature of the light-emitting elements.

In another embodiment of the present invention, the temperature determining means comprises a means for measuring the forward voltage of the light-emitting elements, for example a voltage sensor. The forward voltage can be related to a temperature associated with the light-emitting elements thus enabling this temperature to be determined. For example, the forward voltage of LEDs is dependent on temperature according to the Shockley equation defined as follows:

$$I=I_s(\exp(eV/kT)-1) \quad (1)$$

where, I is the drive current, $I_s$ is the saturation current, e is the charge of an electron, V is the forward voltage, k is Boltzman's constant, and T is the junction temperature of the device.

Figure 3:
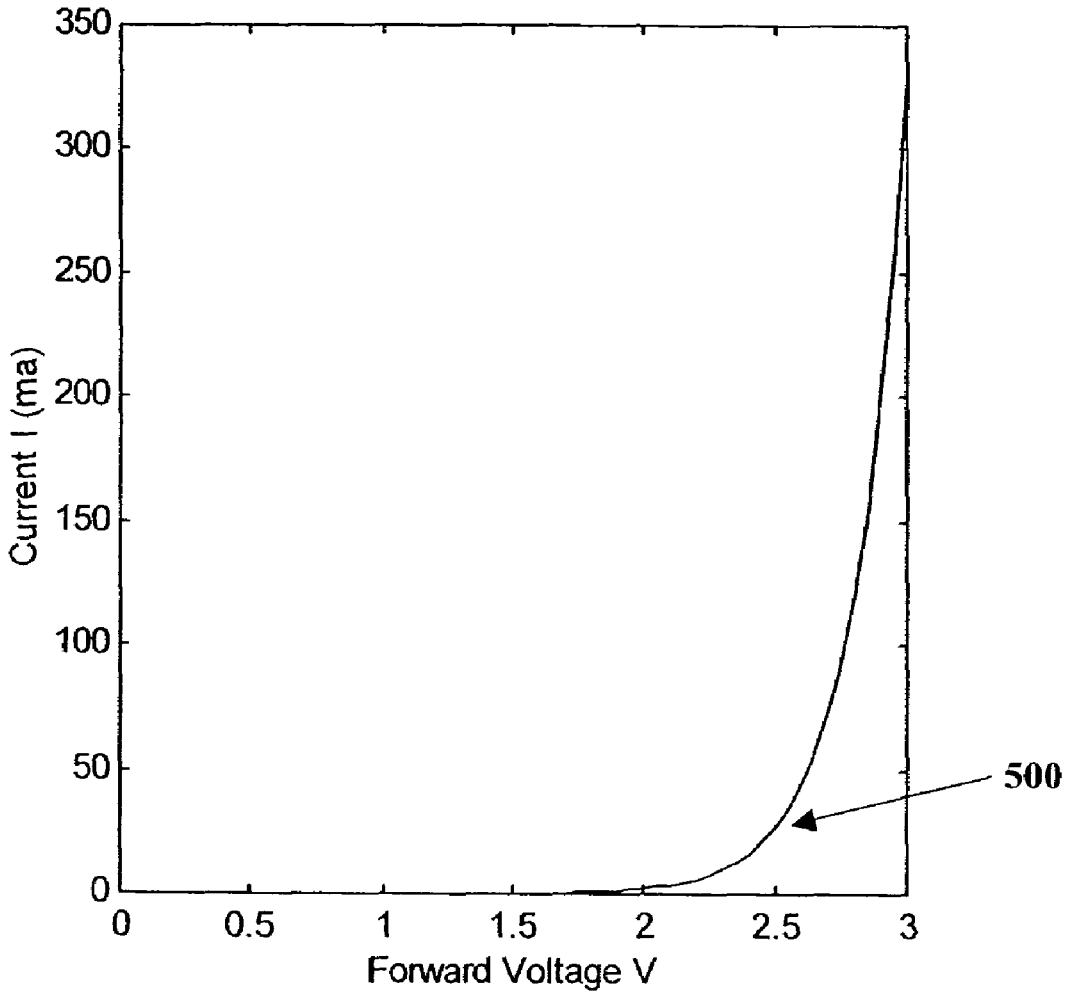
FIG. 3 is a graphical representation of the I-V characteristics of a light-emitting diode.

In one embodiment, junction temperature of a light-emitting element, for example a LED, can be reliably measured by applying a particular bias current that results in the forward voltage being at the "knee" of the I-V characteristic curve. FIG. 3 is an example I-V characteristic curve wherein the "knee" 500 is indicated. Over the temperature range representative of the difference between ambient temperature and operational temperature of a light-emitting element, the temperature dependency thereof can be considered approximately linear at about −2.0 millivolts per degree Celsius.

By monitoring the forward voltage, it is therefore possible to eliminate the need for a temperature sensor. This form of temperature determination mechanism can be convenient as the A/D converters required for this embodiment are typically readily integrated into microcontrollers or control systems used to regulate and control the drive current of a light-emitting element.

In one embodiment of the present invention, the forward voltage of a series of light-emitting elements is measured. This is advantageous in that the forward voltage of the series of light-emitting elements is larger than the individual forward voltage per light-emitting element. Thereby enabling a more accurate measurement to be made due to an improved signal-to-noise ratio, for example.

Control System

The control system receives information representative of the temperature of the one or more light-emitting elements, and subsequently determines an appropriate control signal for the activation of the one or more light-emitting elements based on the temperature thereof.

The control system provides a means to control the supply of drive current to the one or more light-emitting elements. In one embodiment of the present invention, the control system uses digital switching to achieve this form of control. The power supplied to the light-emitting elements can be digitally switched using techniques such as pulse width modulation (PWM), pulse code modulation (PCM) or any other similar approach known in the art.

Methods for the ramping of the current applied to the one or more light emitting elements as defined in the present invention can be controlled in a number of different ways including a controllable variable power supply, a controllable variable resistor to adjust the current from a constant current supply, and/or pulse width or pulse code modulation of the otherwise constant drive current, for example.

In one embodiment a sufficiently high frequency pulse width or pulse code modulation method can provide a means for ramping the current. For example, a short pulse at maximum current can heat the light-emitting element by a predetermined amount and if the length of time of the OFF cycle between the pulse widths is sufficiently short, for example less than the time for the light-emitting element to dissipate the predetermined amount of heat, the subsequent ON pulse can further increase the temperature of the light-emitting element, wherein this process can be repeated until the threshold temperature can be reached.

In an alternate embodiment, the frequency of a high-frequency pulse width modulator can be held constant while its duty factor is progressively increased from 0 percent to 100 percent. The increasing width of the ON portion of each cycle can progressively increase the temperature of the light-emitting element, typically over a period of a few tens of milliseconds.

The control system can be a computing device or microcontroller having a central processing unit (CPU) and peripheral input/output devices (such as A/D or D/A converters) to monitor parameters from one or more peripheral devices that are operatively coupled to the control system, for example a temperature determination mechanism. The controller can optionally include one or more storage media collectively referred to herein as "memory". The memory can be volatile and non-volatile computer memory such as RAM, PROM, EPROM, and EEPROM, floppy disks, compact disks, optical disks, magnetic tape, or the like, wherein control programs (such as software, microcode or firmware) for monitoring or controlling the one or more light-emitting elements and peripheral devices coupled to the control system are stored and executed by the CPU.

In one embodiment the control system comprises a controller and a driver which are formed as separate entities, alternately the controller and driver can be integrated into a single unit. A worker skilled in the art would readily understand a variety of control system configurations that can provide for the activation of the one or more light-emitting elements.

Figure 4A:
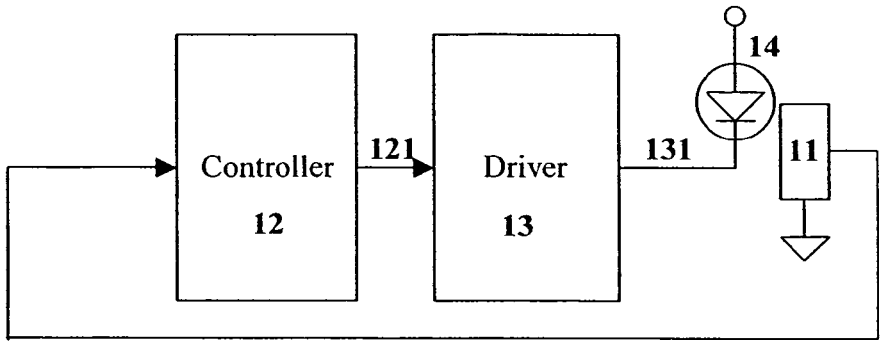
FIG. 4*a* is a schematic representation of a lighting system including an apparatus for controlling thermal stress according to one embodiment of the present invention.

FIG. 4*a* illustrates a schematic representation of one embodiment of the present invention wherein a thermistor 11 positioned proximate to LED 14 is used to determine the temperature of LED 14. Based on the measured temperature value, controller 12 can adjust the signal 121 provided to the driving circuitry 13, which subsequently provides a drive signal 131 to LED 14.

Figure 4B:
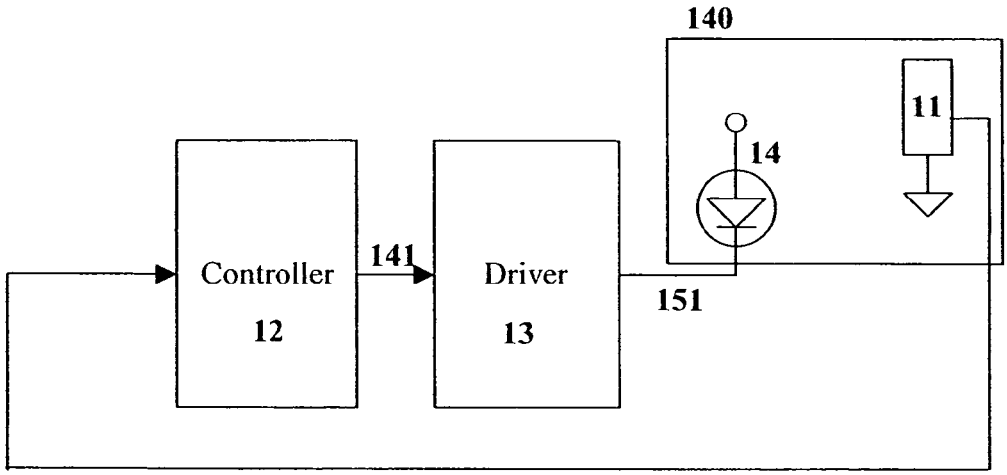
FIG. 4*b* is a schematic representation of a lighting system including an apparatus for controlling thermal stress according to another embodiment of the present invention.

FIG. 4*b* illustrates a schematic representation of another embodiment of the present invention wherein a thermistor 11 is used to determine the temperature of an LED 14. The thermistor 11 and LED 14 are mounted on thermally conductive substrate 140. Based on the measured temperature value, controller 12 can adjust the signal 141 provided to the driving circuitry 13, which subsequently provides a drive signal 151 to LED 14.

Figure 5:
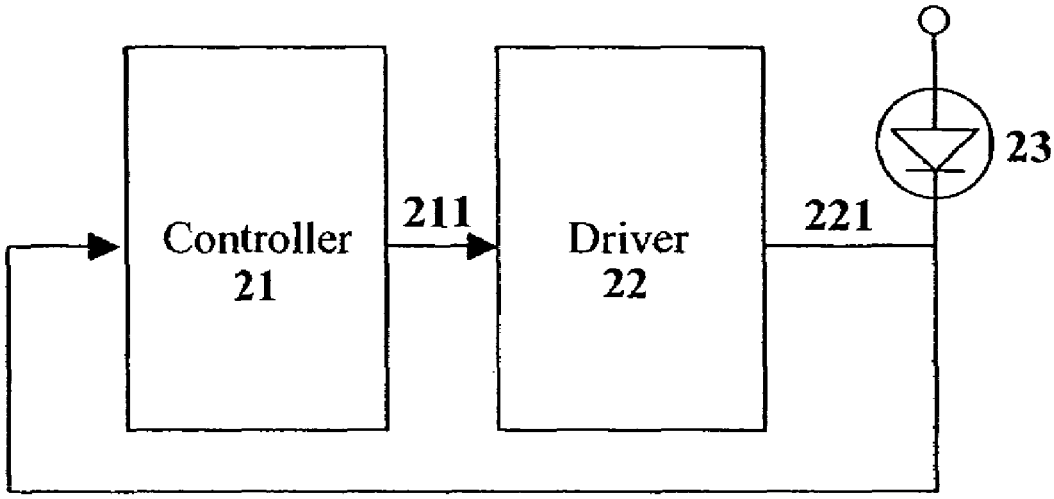
FIG. 5 is a schematic representation of a lighting system including an apparatus for controlling thermal stress according to another embodiment of the present invention.

FIG. 5 illustrates a schematic representation of one embodiment of the present invention wherein a controller 21 is used to determine the forward voltage characteristics of an LED 23 and provide a control signal 211 to driver 22. Driver 22 subsequently provides a drive signal 221 to LED 23 for activation and control thereof.

It is obvious that the foregoing embodiments of the invention are exemplary and can be varied in many ways. Such present or future variations are not to be regarded as a departure from the spirit and scope of the invention, and all such modifications, as would be obvious in the art, are intended to be included within the scope of the following claims.

I claim:

1. An apparatus for controlling a drive signal provided to one or more light-emitting elements, said apparatus comprising:

a) a temperature determination means operatively connected with at least one of the one or more light-emitting elements, the temperature determination means for detecting a first signal representative of an initial device temperature of said one or more light-emitting elements prior to activation of said one or more light-emitting elements; and b) a control means operatively coupled to the one or more light-emitting elements and the temperature determination means, the control means for receiving the first signal and configured to determine an initial drive signal based on the first signal, the control means further for ramping the initial drive signal up to a steady state drive signal based on a predetermined criteria;

wherein the control means is adapted for connection to a source of power.

2. The apparatus according to claim 1, wherein the control means is configured to perform a threshold evaluation between the initial device temperature and a threshold temperature, the threshold evaluation for determining the initial drive signal.

3. The apparatus according to claim 2, wherein the predetermined criteria is a ramping sequence determined based on the initial device temperature, the threshold temperature and a predetermined time period.

4. The apparatus according to claim 3, wherein the predetermined time period is tens of milliseconds.

5. The apparatus according to claim 2, wherein the temperature determination means is configured to detect a second signal representative of a subsequent device temperature of said one or more light-emitting elements and wherein the predetermined criteria includes a second threshold evaluation between the subsequent device temperature and the threshold temperature.

6. The apparatus according to claim 1, wherein the temperature determination means is a temperature sensor.

7. The apparatus according to claim 6, wherein the temperature sensor is positioned proximate to one of the one or more light-emitting elements.

8. The apparatus according to claim 6, wherein the one or more light-emitting elements and the temperature sensor are mounted on a thermally conductive substrate.

9. The apparatus according to claim 1, wherein the temperature determination means is a voltage sensor for detecting forward voltage of one or more of the light-emitting elements.

10. A method for controlling a drive signal provided to one or more light-emitting elements, said method comprising:

a) determining an initial device temperature of said one or more light-emitting elements prior to activation of said one or more light-emitting elements;

b) determining an initial drive signal based on the initial device temperature;

c) providing the initial drive signal to the one or more light-emitting elements; and d) ramping the drive signal from said initial drive signal to a steady state drive signal based on a predetermined criteria.

11. The method according to claim 10, wherein determining an initial device temperature includes detecting a temperature of one or more of the light-emitting elements.

12. The method according to claim 10, wherein determining an initial device temperature includes detecting a forward voltage associated with one or more of the light emitting elements and correlating the detected forward voltage signal to a corresponding device temperature.

13. The method according to claim 10, wherein determining an initial drive signal includes solving a threshold evaluation between the initial device temperature and a threshold temperature.

14. The method according to claim 13, wherein the predetermined criteria is a ramping sequence determined based on the initial device temperature, the threshold temperature and a predetermined period of time.

15. The method according to claim 13, wherein ramping the drive signal includes the steps of detecting a subsequent device temperature and solving the threshold evaluation between the subsequent device temperature and the threshold temperature.

16. The method according to claim 10, wherein providing the initial drive signal is performed using pulse width modulation or pulse code modulation.

17. The method according to clam 16, wherein providing the initial drive signal is performed using pulse width modulation having a constant frequency and a duty cycle and ramping the drive signal is provided by increasing the duty cycle.

18. The method according to claim 17, wherein the duty cycle is increased over a period of tens of milliseconds.

19. An apparatus for reducing thermal stress upon activation of at least one light-emitting diode (LED), the apparatus comprising:

a sensing element, operatively connected to the at least one LED for detecting a first signal representative of a temperature of a junction of the at least one LED prior to activation of the at least one LED; and a controller, connected to the at least one LED and the sensing element for receiving the first signal, determining an initial value based at least in part on the first signal, and providing a ramped drive signal to the at least one LED, wherein a current provided by the ramped drive signal is increased from the initial value to a steady-state value based on at least one predetermined criterion.

20. The apparatus of claim 19, wherein the sensing element is a temperature sensor.

21. The apparatus of claim 19, wherein the sensing element is a voltage sensor for measuring a forward voltage of the at least one LED.

* * * * *